US007956857B2

(12) United States Patent
Willis

(10) Patent No.: US 7,956,857 B2
(45) **Date of Patent: *Jun. 7, 2011**

(54) LIGHT MODULATOR HAVING PIXEL MEMORY DECOUPLED FROM PIXEL DISPLAY

(75) Inventor: Thomas E. Willis, Redwood City, CA (US)

(73) Assignee: Intel Corporation, Santa Clara, CA (US)

( * ) Notice: Subject to any disclaimer, the term of this patent is extended or adjusted under 35 U.S.C. 154(b) by 843 days.

This patent is subject to a terminal disclaimer.

(21) Appl. No.: 11/978,777

(22) Filed: Oct. 30, 2007

(65) Prior Publication Data

US 2008/0062158 A1 Mar. 13, 2008

Related U.S. Application Data

(63) Continuation of application No. 10/086,010, filed on Feb. 27, 2002, now Pat. No. 7,362,316.

(51) Int. Cl.
*G09G 5/00* (2006.01)

(52) U.S. Cl. ..... 345/204; 345/691

(58) Field of Classification Search ..... 345/204, 345/691; 359/242; 348/759, 750, 771
See application file for complete search history.

(56) References Cited

U.S. PATENT DOCUMENTS

| | | | | |
|---|---|---|---|---|
| 5,565,882 | A | 10/1996 | Takanashi et al. | 345/32 |
| 5,589,852 | A * | 12/1996 | Thompson et al. | 345/690 |
| 5,610,624 | A * | 3/1997 | Bhuva | 345/84 |
| 5,682,174 | A | 10/1997 | Chiu | |
| 5,986,796 | A | 11/1999 | Miles | 359/260 |
| 6,072,454 | A | 6/2000 | Nakai et al. | 345/97 |
| 6,107,979 | A | 8/2000 | Chiu et al. | 345/84 |
| 6,573,928 | B1 | 6/2003 | Jones et al. | 348/51 |
| 6,611,274 | B1 | 8/2003 | Keely et al. | 345/600 |
| 6,937,222 | B2 | 8/2005 | Numao | 345/98 |
| 7,038,671 | B2 | 5/2006 | Willis et al. | 345/205 |
| 7,084,861 | B2 | 8/2006 | Iisaka | 345/204 |
| 7,088,325 | B2 | 8/2006 | Ishii | 345/89 |
| 7,362,316 | B2 * | 4/2008 | Willis | 345/204 |
| 2002/0000967 | A1 | 1/2002 | Huston et al. | |
| 2002/0041264 | A1 | 4/2002 | Quanrud | |

FOREIGN PATENT DOCUMENTS

| | | |
|---|---|---|
| EP | 1 164 570 A1 | 12/2001 |
| EP | 1 225 557 A1 | 7/2002 |
| JP | 2000-098954 | 4/2000 |

* cited by examiner

*Primary Examiner* — Abbas Abdulselam
(74) *Attorney, Agent, or Firm* — Trop, Pruner & Hu, P.C.

(57) ABSTRACT

A light modulator such as an SLM, in which the pixel data array is decoupled from the pixel display array. The pixel data array can be located externally, permitting significant reduction in the circuitry present under each pixel of the display, in turn permitting significant reduction in display pixel size and independent scaling of memory cell size and display cell size.

18 Claims, 10 Drawing Sheets

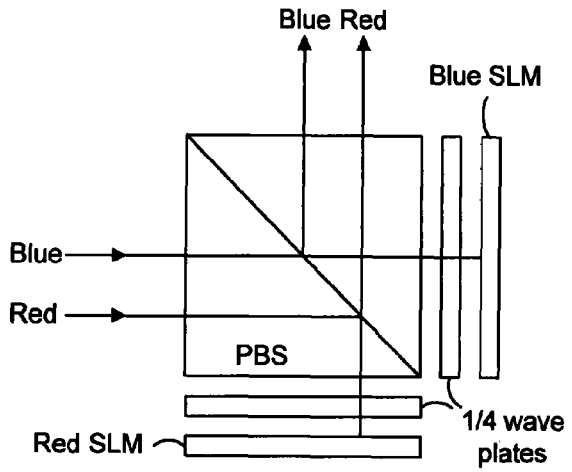
Fig. 7 - prior art
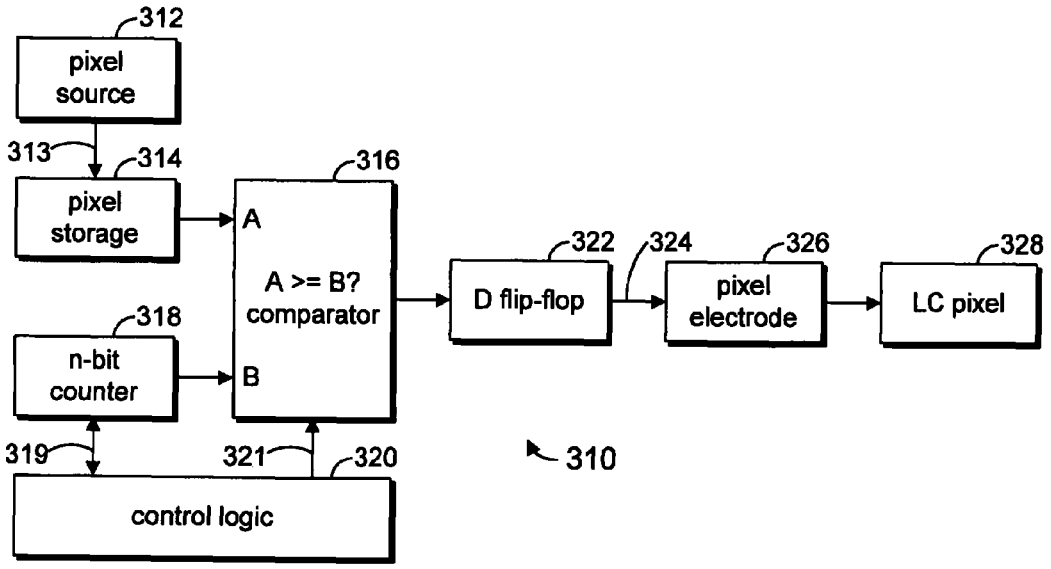
Fig. 8

LIGHT MODULATOR HAVING PIXEL MEMORY DECOUPLED FROM PIXEL DISPLAY

This application is a continuation of U.S. patent application Ser. No. 10/086,010 entitled "LIGHT MODULATOR HAVING PIXEL MEMORY DECOUPLED FROM PIXEL DISPLAY," filed on Feb. 27, 2002 now U.S. Pat. No. 7,362,316.

BACKGROUND

The present invention relates generally to displays, and more particularly, using pulse-width modulation to drive one or more display elements of an electro-optical display, for example, to digitally drive pixels from pulse width modulated waveforms in a liquid crystal display, such as a silicon light modulator with digital storage.

Pulse-width modulation (PWM) has been employed to drive liquid crystal displays (displays). A pulse-width modulation scheme may control displays, including emissive and non-emissive displays, which may generally comprise multiple display elements. In order to control such displays, the current, voltage or any other physical parameter that may be driving the display element may be manipulated. When appropriately driven, these display elements, such as pixels, normally develop light that can be perceived by viewers.

In an emissive display example, to drive a display (e.g., a display matrix having a set of pixels), electrical current is typically passed through selected pixels by applying a voltage to the corresponding rows and columns from drivers coupled to each row and column in some display architectures. An external controller circuit typically provides the necessary input power and data signal. The data signal is generally supplied to the column lines and synchronized to the scanning of the row lines. When a particular row is selected, the column lines determine which pixels are lit. An output in the form of an image is thus displayed on the display by successively scanning through all the rows in a frame.

For instance, a silicon light modulator (SLM) uses an electric field to modulate the orientation of a liquid crystal (LC) material. By the selective modulation of the liquid crystal material, an electronic display may be produced. The orientation of the LC material affects the intensity of light going through the LC material. Therefore, by sandwiching the LC material between an electrode and a transparent top plate, the optical properties of the LC material may be modulated. In operation, by changing the voltage applied across the electrode and the transparent top plate, the LC material may produce different levels of intensity on the optical output, altering an image produced on a screen.

FIG. 7 illustrates a portion of a light engine or projector apparatus that utilizes SLMs, as is known in the art. The projector includes a polarization beam splitter (PBS) which passes light of a first polarization and reflects (at a 90 degree angle) light of a second polarization. As illustrated, blue light of the first polarization and red light of the second polarization enter the PBS, and the blue beam is passed through and the red beam is reflected. Each beam is passed through a respective quarter-wave plate before striking a respective SLM. Each SLM includes a pixel array for modulating the light, and a reflective rear surface for reflecting the modulated beam back through the quarter-wave plate to the PBS. The image-content-injected beams emerge from the PBS, and may then be directed to e.g. a display device (not shown).

Typically, a silicon light modulator (SLM) is a display device where a liquid crystal material (LC) is driven by circuitry located at each pixel. For example, when the LC material is driven, an analog pixel might represent the color value of the pixel with a voltage that is stored on a capacitor under the pixel. This voltage can then directly drive the LC material to produce different levels of intensity on the optical output. Digital pixel architectures store the value under the pixel in a digital fashion. In this case, it is not possible to directly drive the LC material with the digital information, i.e., there needs to be some conversion to an analog form that the LC material can use.

Pulse-width modulation (PWM) may be utilized for driving an SLM device. However, several conventional PWM schemes add up non-overlapping waveforms to build a PWM waveform. Unfortunately, these conventional ways of driving displays using a typical PWM scheme may not be adequate, as multiple edges may get generated in the PWM waveform. Using this approach, for example, the LC material may not be driven by a signal that is a function of the desired color value. Therefore, such a multi-edged PWM waveform that draws upon multiple non-overlapping pulses to build the PWM waveform for driving a display device or display system architecture may not precisely control the LC material being driven. Furthermore, this type of driving control that simply uses a fixed waveform may not be easily tuned to a particular LC material.

Thus, better ways are desired to drive display elements in displays, especially in digital pixel architectures.

BRIEF DESCRIPTION OF THE DRAWINGS

FIG. 7 illustrates a simplified projection system according to the prior art, employing two SLMs.

FIG. 8 illustrates one embodiment of the light modulator.

DETAILED DESCRIPTION

While it will have been clear to the skilled reader of the parent application that the presence of the term "silicon" in the phrase "silicon light modulator" is merely a convenient and customary description in the art, and that neither the various embodiments nor the claims of the parent application are limited to "silicon", the inventor chooses to expressly make the point here. SLMs may be built using a variety of fabrication techniques, semiconductor materials, and so forth.

Figure 1:
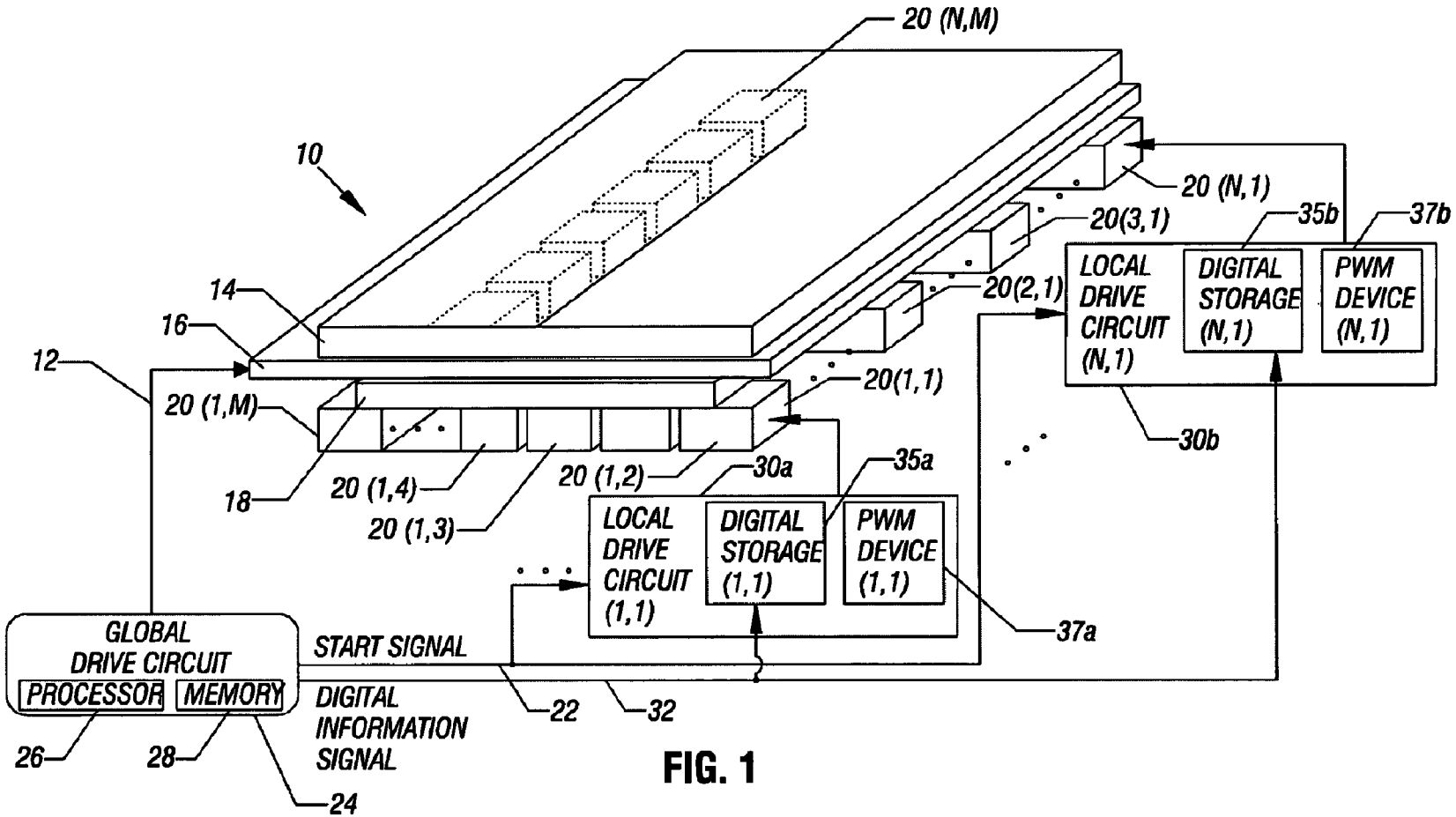
FIG. 1 is a schematic depiction of a display system according to an embodiment of the present invention.

A display system 10 (e.g., a liquid crystal display (display), such as a silicon light modulator (SLM)) shown in FIG. 1 includes a liquid crystal layer 18 according to an embodiment of the present invention. In one embodiment, the liquid crystal layer 18 may be sandwiched between a transparent top plate 16 and a plurality of pixel electrodes 20(1, 1) through 20(N, M), forming a pixel array comprising a plurality of display elements (e.g., pixels). In some embodiments, the top plate 16 may be made of a transparent conducting layer, such as indium tin oxide (ITO). Applying voltages across the liquid crystal layer 18 through the top plate 16 and the plurality of pixel electrodes 20(1,1) through 20(N, M) enables driving of the liquid crystal layer 18 to produce different levels of intensity on the optical outputs at the plurality of display elements, i.e., pixels, allowing the display on the display system 10 to be altered. A glass layer 14 may be applied over the top plate 16. In one embodiment, the top plate 16 may be fabricated directly onto the glass layer 14.

A global drive circuit 24 may include a processor 26 to drive the display system 10 and a memory 28 storing digital information including global digital information indicative of a common reference and local digital information indicative of an optical output from at least one display element, i.e., pixel. Based on a comparison of the global and local digital information, the display system 10 may determine a transition separating a first pulse interval and a second pulse interval in a modulated signal generated for at least one display element, i.e., pixel. Accordingly, from the modulated signal, the display element may be appropriately driven, providing the optical output based on the digital information.

In some embodiments, the global drive circuit 24 applies bias potentials 12 to the top plate 16. Additionally, the global drive circuit 24 provides a start signal 22 and a digital information signal 32 to a plurality of local drive circuits (1, 1) 30*a* through (N, 1) 30*b*, each local drive circuit may be associated with a different display element being formed by the corresponding pixel electrode of the plurality of pixel electrodes 20(1, 1) through 20(N, 1), respectively.

In one embodiment, a liquid crystal over silicon (LCOS) technology may be used to form the display elements of the pixel array. Liquid crystal devices formed using the LCOS technology may form large screen projection displays or smaller displays (using direct viewing rather then projection technology). Typically, the liquid crystal (LC) material is suspended over a thin passivation layer. A glass plate with an indium tin oxide (ITO) layer covers the liquid crystal, creating the liquid crystal unit sometimes called a cell. A silicon substrate may define a large number of pixels. Each pixel may include semiconductor transistor circuitry in one embodiment.

One technique in accordance with an embodiment of the present invention involves controllably driving the display system 10 using pulse-width modulation (PWM). More particularly, for driving the plurality of pixel electrodes 20(1, 1) through 20(N, M), each display element may be coupled to a different local drive circuit of the plurality of local drive circuits (1, 1) 30*a* through (N, 1) 30*b*, as an example. To hold and/or store any digital information intended for a particular display element, a plurality of digital storage (1, 1) 35*a* through (N, 1) 35*b* may be provided, each digital storage may be associated with a different local drive circuit of the plurality of local drive circuits (1, 1) 30*a* through (N, 1) 30*b*, for example. Likewise, for generating a pulse width modulated waveform based on the respective digital information, a plurality of PWM devices (1, 1) 37*a* through (N, 1) 37*b* may be provided in order to drive a corresponding display element. In one case, each PWM device of the plurality of PWM devices (1, 1) 37*a* through (N, 1) 37*b* may be associated with a different local drive circuit of the plurality of local drive circuits (1, 1) 30*a* through (N, 1) 30*b*.

Consistent with one embodiment of the present invention, the global drive circuit 24 may receive video data input and may scan the pixel array in a row-by-row manner to drive each pixel electrode of the plurality of pixel electrodes 20(1, 1) through 20(N, M). Of course, the display system 10 may comprise any desired arrangement of one or more display elements. Examples of the display elements include silicon light modulator devices, emissive display elements, non-emissive display elements and current and/or voltage driven display elements.

Generally, a silicon light modulator (SLM) is a display device where a liquid crystal material (LC) is driven by circuitry located under each pixel. Of course, there are many reasonable pixel architectures for these devices, each of which have implications on how the LC material is driven. For example, an analog pixel might represent the color value of the pixel with a voltage that is stored on a capacitor under the pixel. This voltage can then directly drive the LC material to produce different levels of intensity on the optical output. Digital pixel architectures store the value under the pixel in a digital fashion. In this case, it is not possible to directly drive the LC material with the digital information, i.e., there needs to be some conversion to an analog form that the LC material can use. Therefore, pulse-width modulation (PWM) is utilized for generating color in an SLM device in one embodiment of the present invention. This enables pixel architectures that use pulse-width modulation to produce color in SLM devices. In this approach, the LC material is driven by a signal waveform whose "ON" time is a function of the desired color value.

More specifically, one embodiment of the display system 10 may be based on a digital system architecture that uses pulse-width modulation to produce color in silicon light modulator devices arranged in a matrix array comprising a plurality of digital pixels, each digital pixel including one or more sub-pixels. In one case, the matrix array may include a plurality of columns and a plurality of rows. The columns and rows may be driven by a separate global drive circuit, which may enable localized generation of a pulse width modulated voltage or current waveforms at a digital pixel level to drive the plurality of digital pixels. Alternatively, the plurality of digital pixels may be configured in any other useful or desirable arrangement.

In essence, to digitally drive the digital pixels according to the present invention, one operation may involve storing respective digital information received over the digital information signal 32 at each digital storage 37 associated with a different local drive circuit 30, for driving an associated pixel electrode 20 of the corresponding display element, for example. To indicate the lengths of the first and second pulse intervals forming the modulated signal, a particular timing providing a desired transition may be derived based on the digital information. In turn, the lengths of the first and second pulse intervals of the modulated signals may control the optical output of each display element within a refresh period.

For some embodiments, providing the local digital information may include dynamically receiving video data associated with each display element. However, receiving the video data, in one embodiment, includes programmablly receiving at least one pixel value for each display element. The digital information may be programmbally stored in at least one register associated with each display element. Then, for each display element, a duration of illumination, i.e., an "ON" time within the refresh period may be caused based on the length of the first pulse interval of the modulated signal.

When the display element receives the global and local digital information, the global digital information may be compared to the local digital information to determine a desired timing for a particular single transition in the modulated signal. As a result, this comparison may cause the particular single transition to occur in the modulated signal applied to the display element. Moreover, by varying the duration of application of the modulated signal to the display element, however, an optical output from the display element may be selectively adjusted based on this comparison. This selective adjustment feature may be utilized to compensate for a display nonlinearity of one or more display elements in one embodiment. To further nonlinearly modulate the optical output from the display element, the particular single transition may also be selectively delayed.

Figure 2:
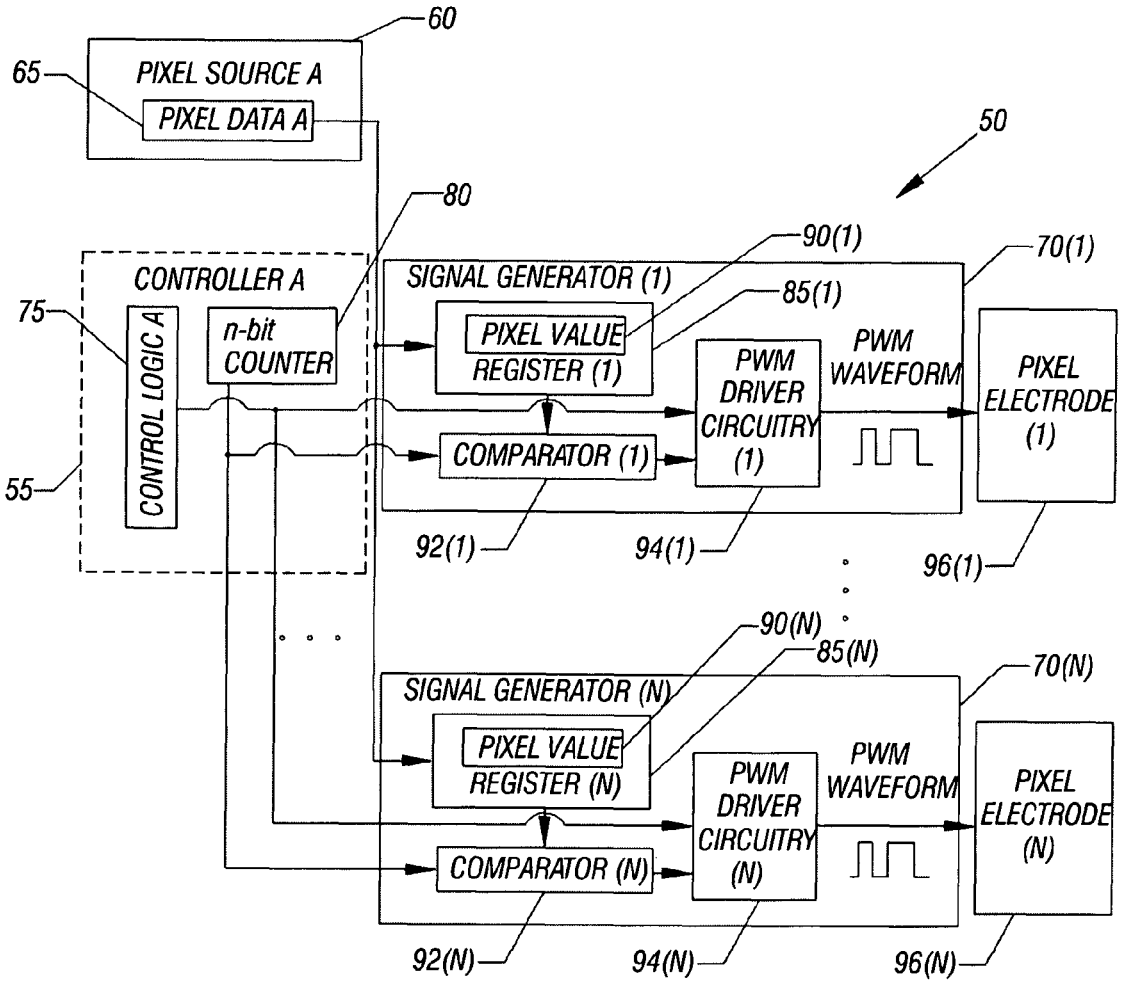
FIG. 2 is a block diagram of a linear silicon light modulator with digital storage employing linear pulse-width modulation (PWM), in accordance with one embodiment of the present invention.

Following the general architecture of the display system 10 of FIG. 1, a linear silicon light modulator (SLM) 50 shown in FIG. 2 includes a controller A 55 to controllably operate the linear SLM 50. For the purposes of storing digital information, the linear SLM 50 may further include a pixel source A 60. The pixel source A 60 stores pixel data A 65 comprising digital information that may include global digital information and local digital information in accordance with one embodiment of the present invention.

Although the scope of the present invention is not limited in this respect, pixel source A 60 may be a computer system, graphics processor, digital versatile disk (DVD) player, and/or a high definition television (HDTV) tuner. In addition, pixel source A 60 may not provide pixel data A 65 for all of the pixels in the display system 10. For example, the pixel source A 60 may simply provide the pixels that have changed since the last update since in some embodiments having appropriate storage for all the pixel values, it will ideally know the last value provided by the pixel source A 60.

The linear SLM 50 may further comprise a plurality of signal generators 70(1) through 70(N), each signal generator associated with at least one display element. Each signal generator 70 may be operably coupled to the controller A 55 for receiving respective digital information. When appropriately initialized, each signal generator 70 may determine a transition in a linearly pulse width modulated waveform based on the digital information to drive a different display element.

As shown in FIG. 2, in one embodiment, the controller A 55 may incorporate a control logic A 75 and a counter 80 (e.g., n-bit wide). The control logic A 75 may controllably operate each display element based on respective digital information. To this end, the counter 80 may provide global digital information indicative of a dynamically changing common reference, i.e., a count, to each display element.

In the illustrated embodiment, each signal generator 70 of the plurality of signal generators 70(1) through 70(N), may comprise a respective register 85 of a plurality of registers 85(1) through 85(N), a respective comparator 92 of a plurality of comparators 92(1) through 92(N), a respective PWM driver circuitry 94 of a plurality of PWM driver circuitry 94(1) through 94(N) to drive a corresponding pixel electrode 96 of a plurality of pixel electrodes 96(1) through 96(N). Each register 85 of the plurality of registers 85(1) through 85(N) may retain for further processing the associated digital information including a corresponding pixel value 90 of a plurality of pixel values 90(1) through 90(N) and/or the count to generate a corresponding linearly pulse width modulated waveform.

Figure 3:
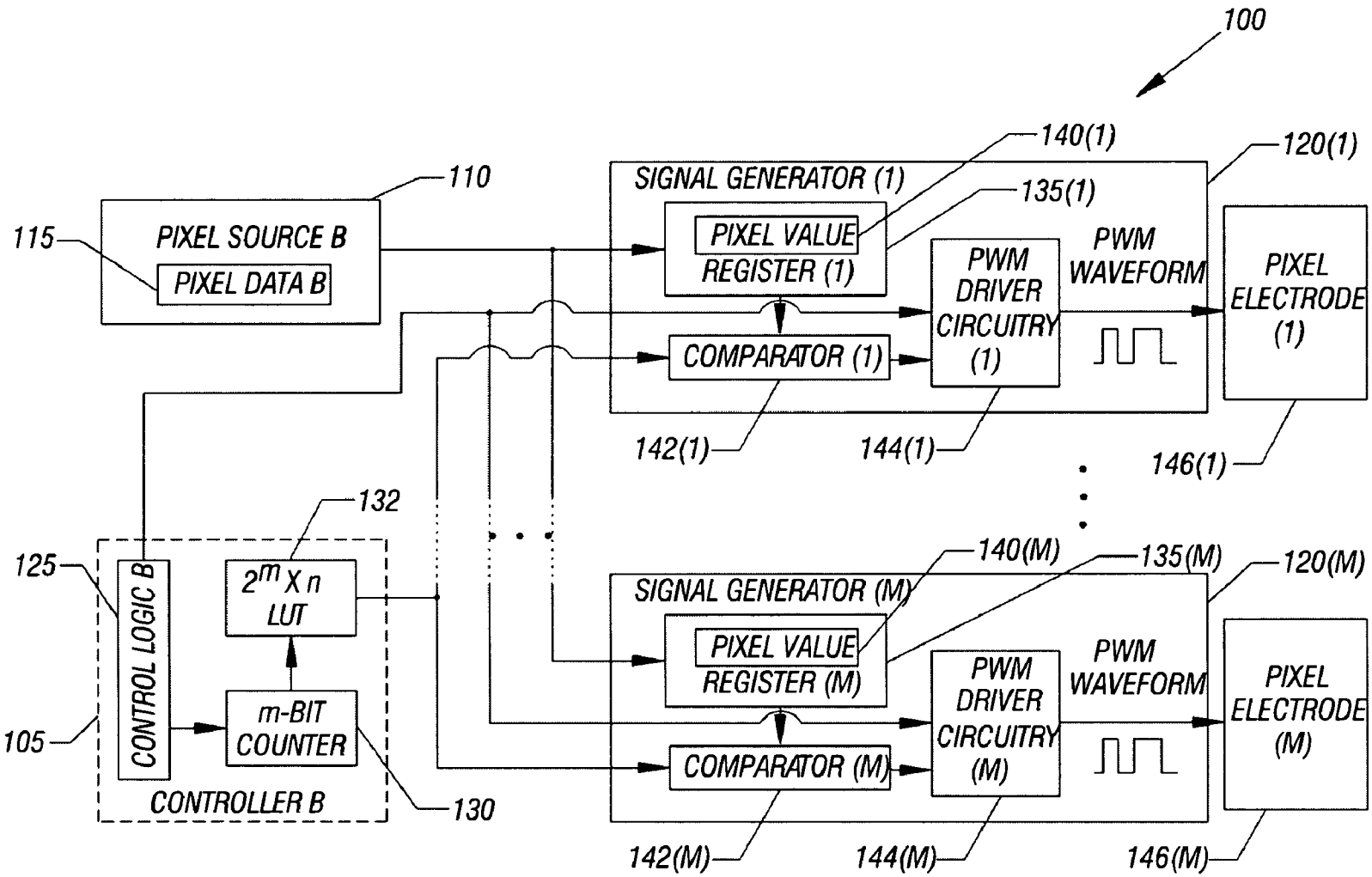
FIG. 3 is a block diagram of a nonlinear silicon light modulator with digital storage employing nonlinear pulse-width modulation, according to an alternate embodiment of the present invention.

Again, following the general architecture of the display system 10 of FIG. 1, a nonlinear silicon light modulator (SLM) 100 shown in FIG. 3 includes a controller B 105 to controllably operate the nonlinear SLM 100. The nonlinear SLM 100 may further include a pixel source B 110 for storing digital information. In accordance with one embodiment of the present invention, the pixel source B 110 stores pixel data B 115 comprising digital information that may include global digital information and local digital information associated with one or more display elements. The nonlinear SLM 100 may further comprise a plurality of signal generators 120(1) through 120(M) where each signal generator 120 may be operably coupled to the controller B 105 for receiving respective digital information for operating any associated display element. In operation, a single transition in a nonlinearly pulse width modulated waveform to drive a different display element, may be determined by each signal generator 120 based on the digital information provided and when appropriately initialized.

Referring to FIG. 3, in one embodiment, the controller B 105 may include a control logic B 125, a counter 130 (e.g., m-bit wide), and a look-up-table (LUT) 132. Each display element may be nonlinearly operated by the control logic B 125 based on respective digital information retrieved from the LUT 132. Here, again global digital information indicative of a dynamically changing common reference, i.e., a count, may be provided to each display element by the counter 130 via the LUT 132.

Each signal generator 120 of the plurality of signal generators 120(1) through 120(M), in the depicted embodiment, may comprise a respective register 135 of a plurality of registers 135(1) through 135(M), a respective comparator 142 of a plurality of comparators 142(1) through 142(M), a respective PWM driver circuitry 144 of a plurality of PWM driver circuitry 144(1) through 144(M) to drive a corresponding pixel electrode 146 of a plurality of pixel electrodes 146(1) through 146(M). Each register 135 of the plurality of registers 135(1) through 135(M) may store the associated digital information including a corresponding pixel value 140 of a plurality of pixel values 140(1) through 140(M) and the count to generate a corresponding nonlinearly pulse width modulated waveform. As described earlier in the context of the linear SLM 50 of FIG. 2, in a similar fashion, the corresponding nonlinearly pulse width modulated waveform may be formed for a corresponding pixel electrode 146 of a plurality of pixel electrodes 146(1) through 146(M).

FIG. 8 shows another embodiment of the invention. A display system 310 includes a pixel source 312 which sends pixel data values to a pixel storage 314 over a suitable communication link 313. In the simplified example shown, the pixel storage is represented as being only a register or other suitable storage for storing a single pixel's data value; however, the skilled reader will understand that this simplification is only for ease in explanation. The pixel storage provides its stored value as a first (A) input to a comparator 316. In the illustrated embodiment, the comparator performs a "greater than or equal to" comparison, as denoted by "A>=B?" Other comparisons may be used in other embodiments, such as "A>B?" or "A<=B?" with appropriate modification to the PWM scheme and counter. (For example, the counter could count downward and the pixel could be turned ON when the appropriate count value is reached, rather than being turned off as in the illustrated embodiment.) Furthermore, the reader will appreciate that digital functions other than comparison could be employed, and that a comparison is only one example of a suitable digital function.

The other (B) input to the comparator comes from a global counter 318. The counter is an n-bit counter, wherein "n" is the number of bits of color depth in the particular pixel. The skilled reader will appreciate that, in various embodiments of the system, there may be more than one such global counter 318. For example, a particular application may call for a red-green-blue (RGB) color scheme using 16 bits to represent the three sub-pixels, and in which red and blue each have five bits and green has six bits of the sixteen. In such a case, the "green pixels" (which may alternatively be called sub-pixels) may be driven by a global six-bit counter, while the red and blue sub-pixels may be driven by a global five-bit counter. In other embodiments, a single, configurable or programmable counter may be used in an interleaved or time-sliced mode in which, for example, it counts to a first value for the red pixels, a second value for the green pixels, and a third value for the blue pixels. The skilled reader will appreciate other such permutations of this invention, in view of this disclosure. For example, the invention is not limited to use in the RGB color space. As another example, the invention may find utility outside the realm of SLMs, such as in driving flat panel plasma or LCD displays or the like.

The counter and the comparator are controlled by control logic 320 over links 319 and 321, respectively. The output of the comparator is provided to the pixel electrode 326 which controls the display of the liquid crystal pixel 328. In embodiments in which the output of the comparator is not suitable for directly powering the electrode, the output may be buffered or otherwise enhanced, such as by a D flip-flop 322 and other suitable means (not shown).

Figure 9:
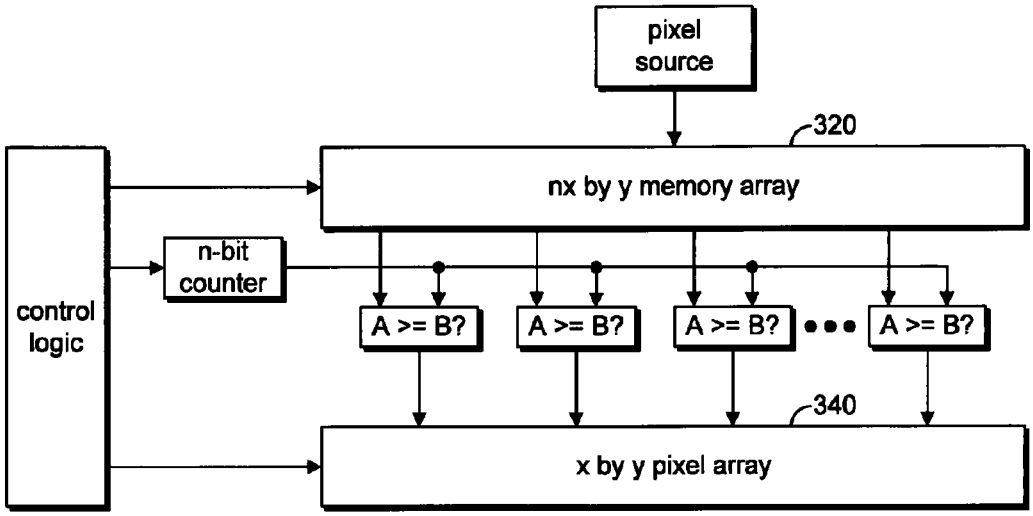
FIG. 9 illustrates another embodiment of the light modulator.

FIG. 9 illustrates an embodiment of the invention, similar to that of FIG. 8 but, rather than illustrating only a single pixel's associated circuitry, multiple pixels' circuitry 330 is shown. The pixel source feeds a memory array 332, whose contents are provided to multiple comparators (such as one per column, typically), which in turn drive a pixel array 334. The memory array is indicated as an "nx by y memory array" to suggest that it is x rows by y columns, and n bits per pixel (or, more accurately, sub-pixel).

The memory array 332 is physically decoupled and distinct from the pixel array. This enables the memory array and pixel array to scale independently. That is, improvements or changes in the circuitry, configuration, layout, size, etc. of one of them can be made independently of any such changes (or lack thereof) in the other. It may often be the case that the pixel array cells (each of which may now typically include in its driver circuitry a comparator, a flip-flop, and an electrode) can be manufactured at a much smaller size than if each were also required to include a storage device for storing the pixel value. It may also be the case that the separated pixel array and memory array can be fabricated on more convenient areas of a die, on separate die, or even using different fabrication or semiconductor technologies.

Figure 10:
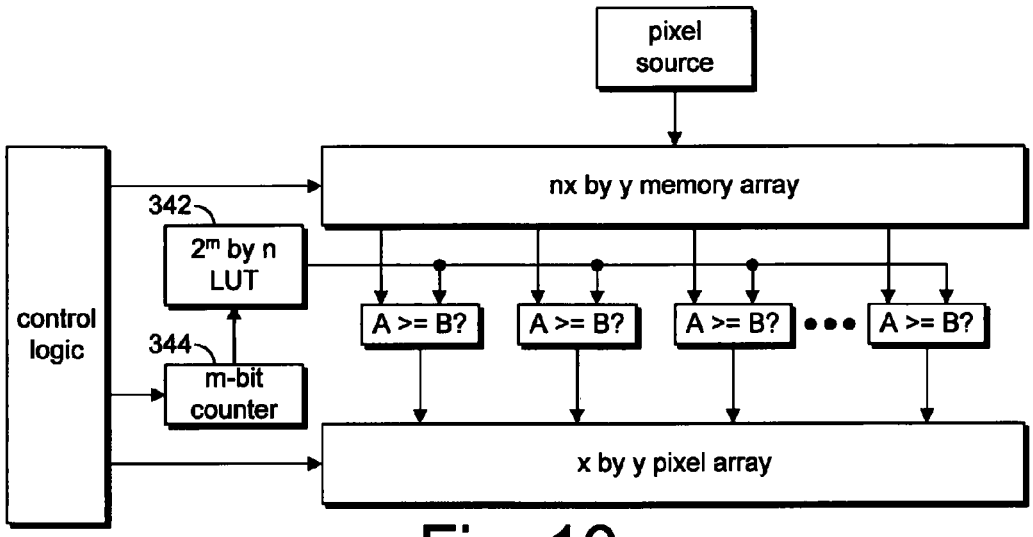
FIG. 10 illustrates yet another embodiment of the light modulator.

FIG. 10 illustrates another embodiment of a system 340 utilizing this invention. This embodiment is of the lookup table variety discussed above, and includes the distinct memory array and pixel array, as well as the lookup table 342 and m-bit counter 344.

The reader will appreciate that, while FIGS. 9 and 10 illustrate embodiments in which an nx-by-y memory array drives an x-by-y pixel array, other configurations of the memory array are within the scope of this invention. For example, the memory array could be built as an nx/2-by-2 y array, or any other configuration suitable to the application at hand. The reader will also appreciate that various other embodiments of utilizing the comparators are within the scope of this invention. For example, rather than having one comparator per column, adjacent columns could share a time-multiplexed comparator. Or, all columns could share a single time-multiplexed comparator. At the other extreme, each pixel could have its own comparator.

Figure 11:
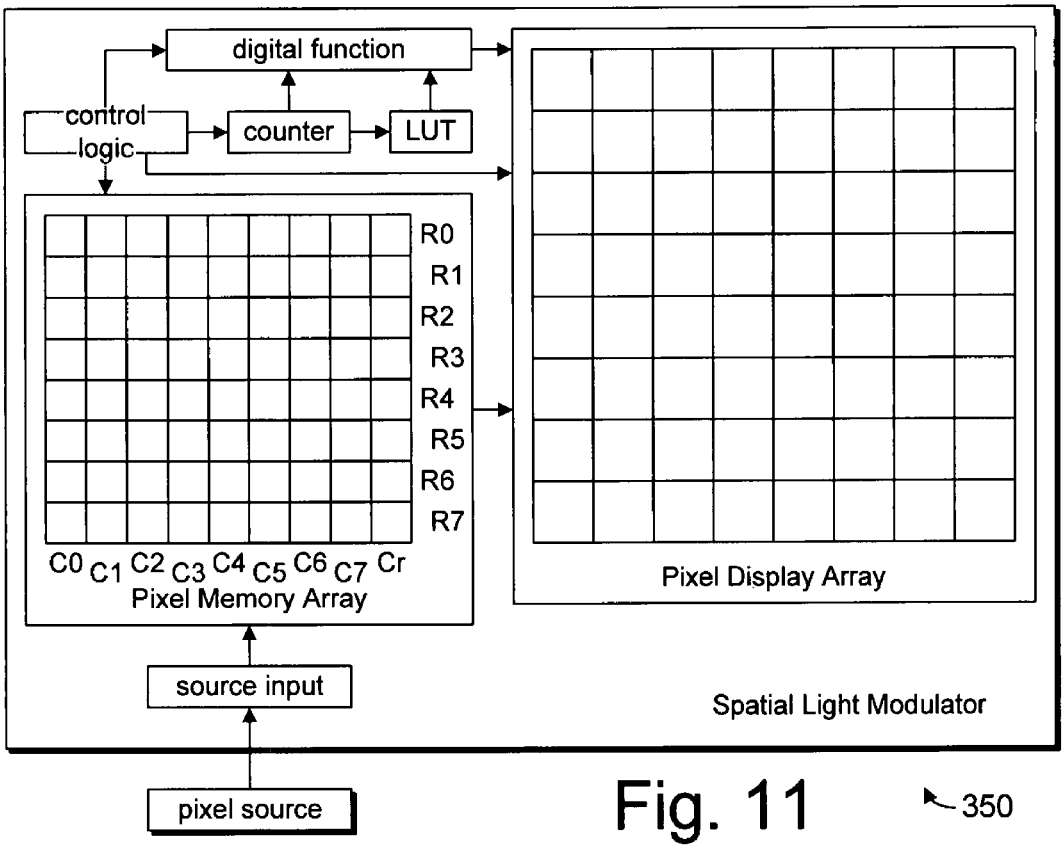
FIG. 11 illustrates one embodiment of a physical layout of the light modulator.

FIG. 11 illustrates one exemplary layout of a spatial light modulator 350 constructed according to the principles of this invention. The light modulator may include a source input at which it receives pixel data values from an external pixel source. Alternatively, the pixel source may be integral with the light modulator. The pixel data are provided from the source input to a pixel memory array, which may be arranged in rows and columns. In the example shown, there are eight rows of pixel data (R0 to R7), and eight columns of pixel data (C0 to C7), and a redundant column (Cr) which may be utilized, using conventional means, for providing redundancy and repair facilities such that the memory array as a whole continues to function even with the loss of one or more of its memory cells, as is well understood in the art.

Control logic provides control signals to the pixel memory array, to a pixel display array, and to the counter. Alternatively, a lookup table (LUT) may be employed, as explained above.

The pixel memory array and the pixel display array are physically distinct. That is, the cells of the pixel memory array (or at least some of them, in some embodiments) are located outside the boundaries of the pixel display array. The circuitry required beneath each display pixel is thus reduced, by moving at least its associated pixel data value storage cell to the outside location. The size of each display pixel can be reduced, and thus the resolution of the display is improved. The PWM update is decoupled from the pixel value update. This may, in some cases, enable a higher quality display. The memory array can be whatever size it needs to be, generally without impacting the display pixel size. Redundant memory cells, and other desirable features, can be added to the memory array generally without impacting the size of the pixel display or its individual cells. In some embodiments, it may prove desirable to provide some level of storage within some or all of the pixel display array cells, while also providing additional pixel data value storage outside the display area.

Alternatively, FIG. 11 may be understood to represent a liquid crystal display, a plasma display, organic light emitting diode (OLED) display, or other such display in which each pixel is independently driven (as opposed to a cathode ray tube, in which all pixels are commonly driven by a modulated beam).

The skilled reader should appreciate that it is not necessary that all pixels in the display be of the same shape or size, nor that the display array be rectangular or regular. In some applications, it may be desirable that only a subset of the pixels in the display be built according to this invention. For example, a display might have a low-resolution area in which the pixels are large enough that it is acceptable, or perhaps even desirable, that the pixel value storage be located under the respective pixel display cells, and a high-resolution area in which this invention is employed and the pixel storage is located elsewhere. In such cases, the pixel storage could be located remotely from the entire display, or it might be located under the low-resolution area's cells. A wide variety of configurations will be appreciated, in light of this disclosure.

Figure 4A:
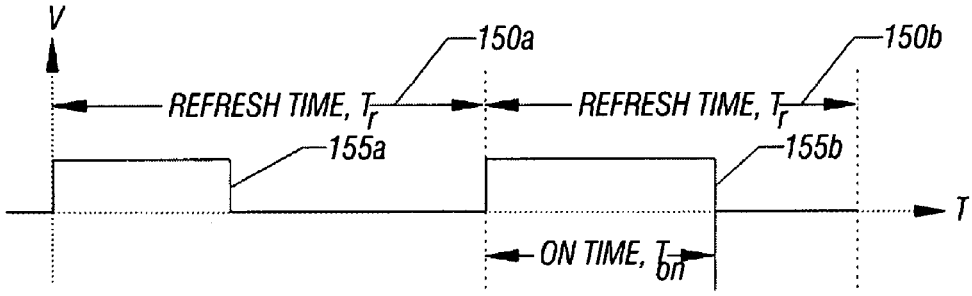
FIG. 4A is a hypothetical graph of applied voltage versus time for a silicon light modulator (SLM) in accordance with one embodiment of the present invention.

A hypothetical graph of an applied voltage versus time, i.e., a drive signal (e.g., a PWM waveform) is shown in FIG. 4A for a silicon light modulator in accordance with one embodiment of the present invention. Within a first refresh time period, $T_r$, 150*a*, the drive signal including a first transition 155*a* and during the next cycle, i.e., within a second refresh time period, $T_r$, 150*b*, the drive signal including a second transition 155*b* may be applied to the pixel electrode 96(1) of FIG. 2, for example. Each transition of the first and second transitions 155*a*, 155*b*, separates the drive signal in a first and second pulse intervals. The first pulse interval of the second refresh time period 150*b* is indicated as the "ON" time, $T_{on}$, as an example.

In some embodiments, the "ON" time, $T_{on}$, of the drive signal of FIG. 4A is a function, $f_{pwm}$, of the current pixel value, p, where $p \in [0,2.^n-1]$, n is the number of bits in a color component (typically 8 for some computer systems), $T_{on} \in [0, T_r]$, and $T_r$ is a constant refresh time. For example, if $f_{pwm}$, is linear, then $T_{on}$ may be given by the following equation:

$$T_{on} = f_{pwm}(p) = \frac{p}{2^n - 1} T_r \tag{1}$$

The first and second refresh time periods, i.e., $T_r$, 150*a* and 105*b*, may be determined depending upon the response time, i.e., $T_{resp}$, of the liquid crystal (LC) material along with an update rate, i.e., $T_{update}$, (e.g., the frame rate) of the content that the display system 10 (FIG. 1) may display when appropriately driven. Ideally, the refresh time periods, i.e., $T_r$, 150*a* and 150*b* may be devised to be shorter than that of the update rate, $T_{update}$, of the content, and the minimum "ON" time, minimum ($T_{on}$), may be devised to be larger than the response time, $T_{resp}$, of the LC material. However, $T_{on}$, may be time varying as a pixel value "p" may change over time.

It is often desirable to use a non-linear function for $f_{pwm}$ to match this function with other non-linear aspects of the display system 10. The function $f_{pwm}$ may be realized through a variety of conventional hardware. As the function $f_{pwm}$ is a function of the pixel value "p," some portion of this hardware may be locally disposed at each pixel in the display system 10, e.g., the linear SLM 50 of FIG. 2 or the nonlinear SLM 100 of FIG. 3. In any event, by advantageously moving as much of the functionality as possible into components that can be globally shared, i.e., within the global drive circuit 24 of FIG. 1, this hardware portion that is disposed locally at each pixel may be significantly reduced. As an example, FIG. 3 illustrates an SLM that uses this approach. In this example, the display system 10 employs the LUT 132 to generate the PWM function $f_{pwm}$ that is non-linear in nature.

Figure 4B:
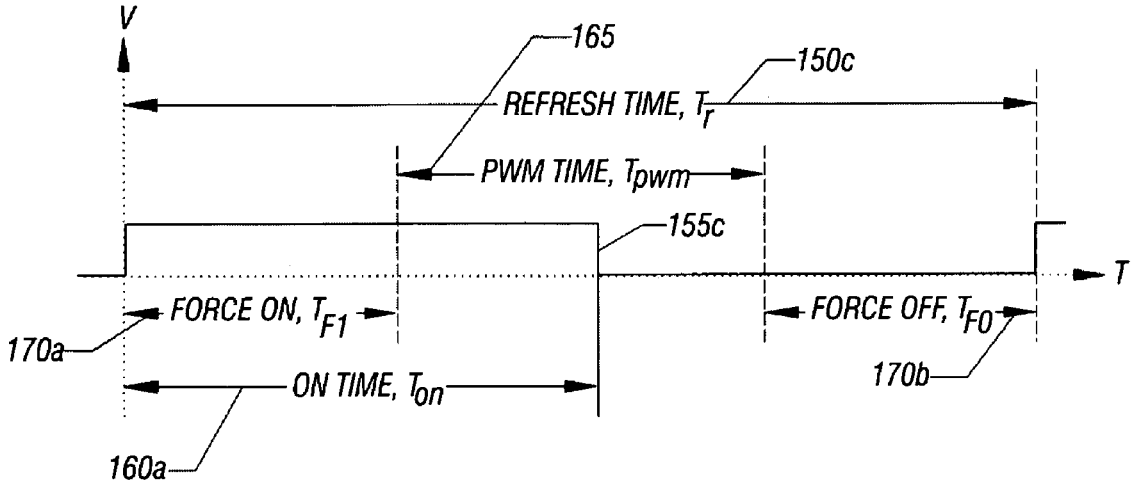
FIG. 4B is a hypothetical graph of adjusted applied voltage versus time for a SLM in accordance with another embodiment of the present invention.

Another useful feature according to one embodiment of the present invention enables the display system 10 to adjust the portion of the first and second refresh time periods, i.e., $T_r$, 150*a* and 150*b*, that is devoted to the PWM waveform. By adding additional delay, the LCD system 10 can produce an adjusted PWM waveform shown in FIG. 4B, which shows another hypothetical graph of the applied voltage versus time that is selectively adjusted to provide an adjusted drive signal as shown for a silicon light modulator according to one embodiment of the present invention. During a refresh time period, $T_r$, 150*c* the applied voltage may be adjusted to form the adjusted drive signal to include a delayed transition 155*c*, providing an adjusted "ON" time, $T_{on}$, 160*a*.

As shown in FIGS. 2 and 3, in one embodiment, either one of the controllers A 55 or B 105 may operate as follows. In step 1, either one of the control logics A 75 or B 125 may present a "start" signal (e.g., the start signal 22 of FIG. 1) to each PWM driver circuitry (N) 94 or (M) 144, which may generate a corresponding PWM waveform for the attached pixel at each pixel electrode of the pixel electrodes (N) 96 or (M) 146. In step 2, each PWM driver circuitry (N) 94, or (M) 144 in each pixel turns its output "ON" in response to the "start" signal.

The n-bit counter 80 (where "n" may be the number of bits in a color component) may begin counting up from zero at a frequency given by $2^n/T_r$ in step 3. In step 4, each pixel monitors the counter value using comparator circuits (N) 92 that compares two n-bit values, i.e., the counter and pixel values "c," "p" for equality. An n-bit register (N) 85 may hold the current pixel value for each pixel. When a pixel finds that the counter value "c" is equal to its pixel value "p," the PWM driver circuitry (N) 94 turns its output "OFF." This process repeats in an iterative manner by repetitively going back to the step 1 based on a particular implementation.

Forced delays may be introduced in some embodiments to generate an adjusted PWM waveform, for example, having a time period indicated as $T_{pwm}$165. In particular, a first force "ON" time, $T_{f1}$, 170*a*, and a second force "ON" time, $T_{f0}$, 170*b*, may be introduced in one embodiment. Adding additional delay between the steps 2 and 3 creates the first force "ON" time, $T_{f1}$. Adding additional delay between the steps 3 and 4 creates the second force "OFF" time, $T_{f0}$. Although adding these times can bound the minimum and maximum portion of the first and second refresh time periods, i.e., $T_r$ 150*a* and 150*b*, that is spent within the PWM waveform during the "ON" state, however, a new PWM waveform with a single transition may still be generated accordingly.

At each pixel, the output waveform of the PWM driver circuitry (N) 94 (which drives the LC material) is "ON" for "p" counter increments (p is the pixel value). Because there are $2^n$ clock ticks each refresh time, $T_r$, this generates a linear PWM waveform given by Equation (1). The logic necessary to load video data (e.g. pixel values) into the pixel array is not shown. However, if the video data, i.e., a pixel value load occurs asynchronously to the PWM behavior, either one of the control logics A 75 may direct the PWM driver circuitry (N) 94 to turn "OFF" its output when writing a value less than the current counter value into any pixel. With appropriate design, the logic to perform this additional comparison can be located outside of the pixel array since this operation does not depend on a pixel value.

Since transfer curves for most LC material are non-linear, it is desirable to be able to generate non-linear PWM functions. FIG. 3 illustrates a modified version of the system shown in FIG. 2 that allows for non-linear PWM functions, $f_{pwm}$. In this figure, the counter value "c" that is provided to the pixels comes from the look-up-table (LUT) 132. The values in the LUT 132 may be monotonically increasing and in the interval $[0, 2^n-1]$, for example. The LUT 132 is indexed by the output of the m-bit counter 130 that operates at a higher frequency, $2^m/T_r$, than the n-bit counter 80 from FIG. 2 (i.e., m>n).

In this way, the LUT 132 in conjunction with the m-bit counter 130 may allow the nonlinear SLM 100 to quantize the refresh interval into $2^m$ intervals (where m>n) so that it can provide a fine control over the duration of the "ON" times for a PWM waveform according to one embodiment. Accordingly, the embodiment in FIG. 3 may add non-linearity by chopping up the refresh time into smaller chunks ($2^m$ chunks, specifically) and then use the LUT 132 to map the smaller chunks onto pixel values. For example, at count "i," all pixels with value "p" (i.e., LUT[i]=p) may be turned "OFF." By appropriately programming the LUT 132, non-linear PWM functions may be suitably furnished. Likewise, using the LUT 132, in some embodiments, forced delays may also be introduced by programming the transitions for pixel values to occur after the m-bit counter 130 reaches a value that corresponds to the force "ON" time and by making sure that all pixel values transition before the force "OFF" time.

By selecting the values in the LUT 132, the time that a given n-bit value is presented to the pixels may be suitably varied (note that in the linear case, all n-bit values are presented to the pixel for the same duration). Instead of varying the m-bit counter 130 signal over time as is done in FIG. 3, it is also possible to allow for non-linear PWM functions by changing the rate at which the counter 130 circuit is clocked by dynamically changing this clocking signal with a voltage-controlled oscillator. By allowing the ability to program the values in the LUT 132 dynamically, the PWM function, $f_{pwm}$ may be tuned to a specific transfer curve associated with the LC material that, e.g., the display system 10 of FIG. 1 may use.

Figure 5:
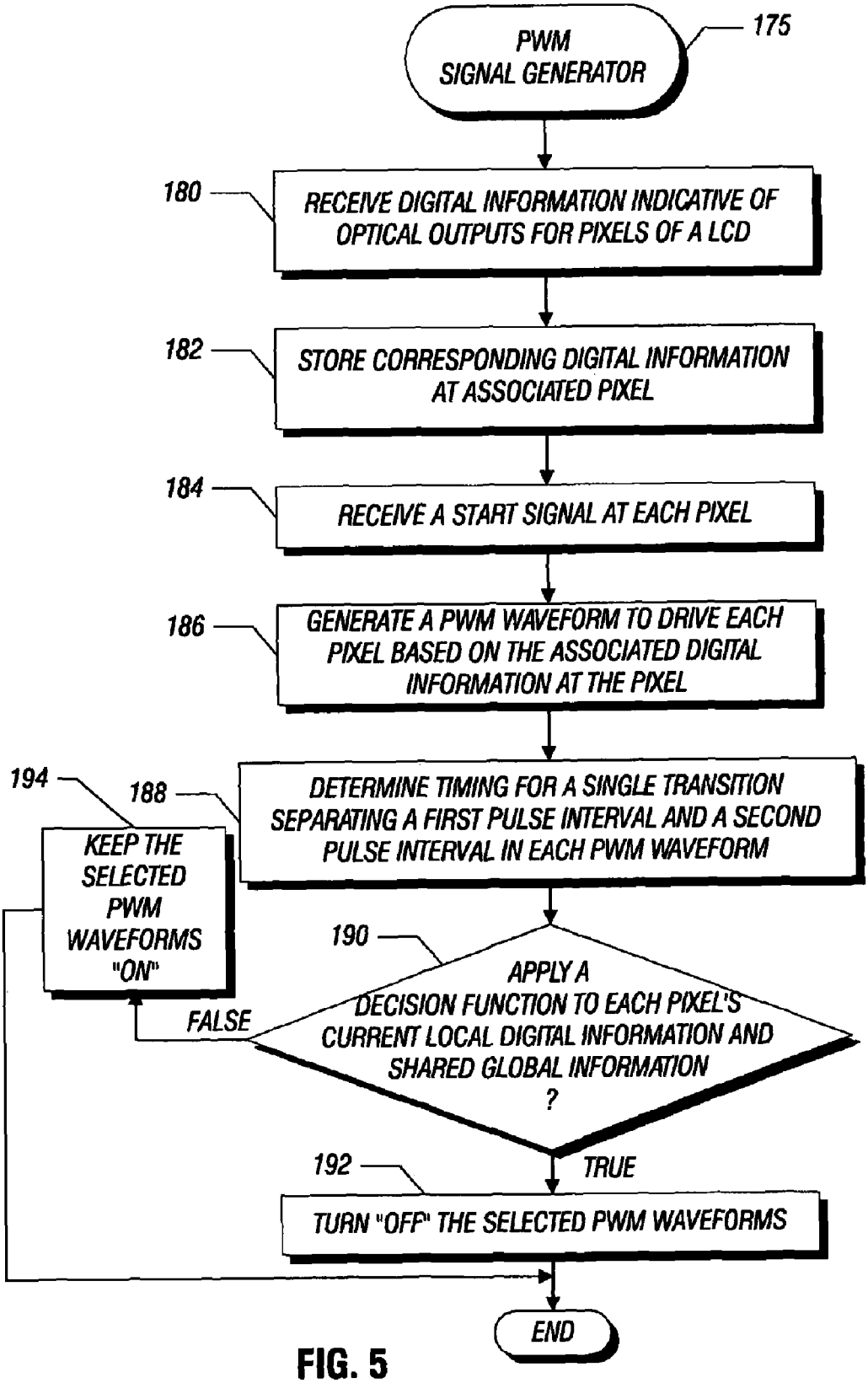
FIG. 5 is a flow chart of a PWM signal generator to digitally drive pixels from pulse width modulated waveforms in accordance with one embodiment of the present invention.

A PWM signal generator 175 (i.e., either a combination of all the plurality of the signal generators 70(1) through 70(N) of FIG. 2 or a combination of all the plurality of the signal generators 120(1) through 120(N) of FIG. 3) is shown in FIG. 5 to digitally drive pixels from pulse width modulated waveforms in accordance with one embodiment of the present invention. While the scope of the present invention is not so limited in this respect, a single pass through the PWM signal generator 175 for one refresh period or interval is illustrated in FIG. 5, as an example.

Each register 85(FIG. 2) of the plurality of registers 85(1) through 85(N) may dynamically receive video data associated with a different display element to cause the "ON" time within the refresh period based on the corresponding linearly pulse width modulated waveform at block 180. Corresponding digital information including video data having a corresponding pixel value may be programmbally received at each display element. More specifically, each register 85 of the plurality of registers 85(1) through 85(N) may store the corresponding pixel value 90 of the plurality of pixel values 90(1) through 90(N) at block 182.

At each pixel electrode 96 (FIG. 2) of the plurality of the pixel electrodes 96(1) through 96(N), the start signal 22 (FIG. 1) may be received in block 184. Each PWM driver circuitry 94 (FIG. 2) of the plurality of PWM driver circuitry 94(1) through 94(N) may form a respective pulse width modulated waveform based on associated digital information at the pixel at block 186. According to one embodiment, each signal generator 70 (FIG. 2) of the plurality of signal generators 70(1) through 70(N) may determine the timing for a single transition to form the corresponding pulse width modulated waveform based on the current digital information at block 188.

When provided, the single transitions of the corresponding pulse width modulated waveforms may control the optical outputs from the associated display elements within a refresh period. Additionally, each signal generator 70 of the plurality of signal generators 70(1) through 70(N) may drive an associated display element from the corresponding pulse width modulated waveform, providing a dynamically changing optical output based on the current digital information made available.

A check at the diamond 190 may provide a desired transition in each pulse width modulated waveform driving the associated display element, as each comparator 92 (FIG. 2) of the plurality of comparators 92(1) through 92(N) may compare the global digital information, i.e., the count with the local digital information. If determined to be equal, the pulse width modulated waveforms may be turned "OFF" at block 192. Conversely, if determined to be different, the pulse width modulated waveforms may be kept "ON" at block 194.

Figure 6:
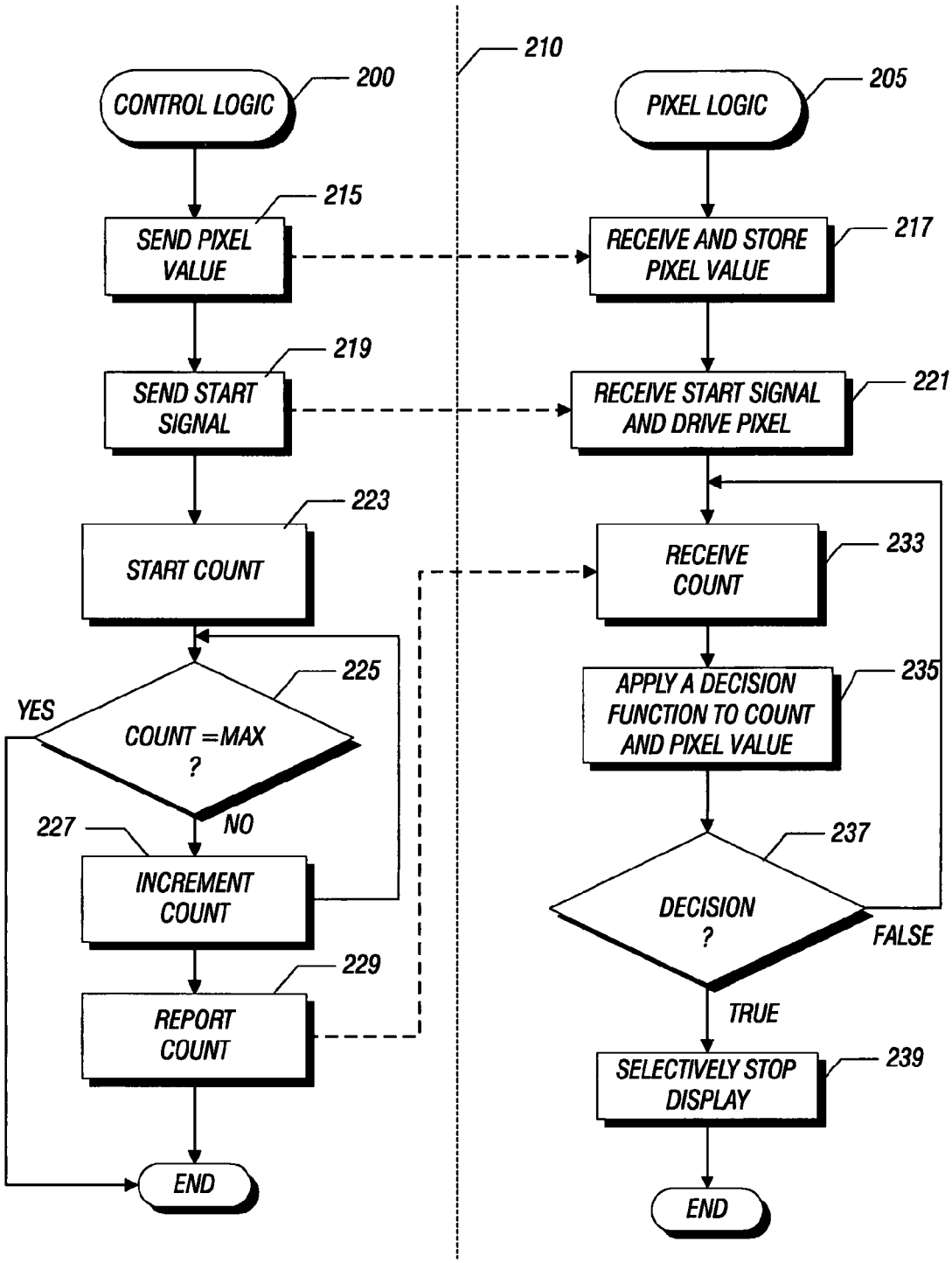
FIG. 6 is a flow chart of a control logic and a pixel logic consistent with one embodiment of the present invention.

To digitally drive pixels from pulse width modulated waveforms, a control logic 200 (e.g., for the global drive circuit 24 of FIG. 1) and a pixel logic 205 (e.g., for each local drive circuit of the plurality of local drive circuits (1, 1) 30*a* through (N, 1) 30*b* of FIG. 1) consistent with one embodiment of the present invention are shown in FIG. 6. For the ease of the presentation, a hypothetical dotted line 210 functionally distinguishes the control logic 200 from the pixel logic 205. According to one embodiment, to provide digital information entails sending a pixel value to each display element at block 215 using the control logic 200. A corresponding pixel value may be received at each display element for storage in a register located at each display element at block 217. At block 219, the start signal 22 (FIG. 1) may also be sent from the control logic 200 to each display element.

Specifically, to drive the display element, e.g., the pixel, the start signal 22 (FIG. 1) may be properly received at the pixel logic 205 at block 221. A count may be started by the control logic 200 at block 223 for iteratively providing multiple count values to the pixel logic 205. A check at diamond 225 may compare the current count value "COUNT" to a predefined value, for example, a maximum value "MAX." If the "COUNT" is determined to be same as that the "MAX," a first refresh interval is over and another pass may begin. Conversely, a looping sequence occurs by first incrementing the "COUNT" at block 227, and then returning for another comparison to the diamond 225. However, in accordance with one embodiment, each incremented "COUNT" may be iteratively reported back to the pixel logic 205 at block 229 until the "COUNT" reaches the "MAX." In this way, cooperatively the control logic 200 and pixel logic 205 go through a single pass during a single refresh period. This routine may be repeated based on a particular application, desiring a display over multiple refresh periods.

By starting the count in block 223 for subsequent reporting thereof to each display element, and responsive to the start signal 22 (FIG. 1) and the count at block 233, a modulated signal may be generated accordingly for each display element. In doing so, the pixel value may be compared to the count at block 235; the timing of a respective single transition may be determined to drive each display element.

In this way, based on a determination for timing of a prospective single transition for each display element, a single transition may be suitably caused in each modulated signal at block 237. When the global and local digital information, i.e., the pixel value and the count are substantially equal, one transition may be caused from an "ON" logic state to an "OFF" logic state in the modulated signal, as an example, stopping the display at block 239. On the other hand, another transition may be caused from an "OFF" logic state to an "ON" logic state in the modulated signal when the global and local digital information are different, iterating back to receive a new count at the block 233.

Thus, one embodiment of the present invention locally generates a PWM waveform to digitally drive a pixel. The PWM waveform includes a single "ON" pulse rather than the addition of non-overlapping "ON" pulses (i.e., there is a single "ON" to "OFF" transition in the PWM waveform each refresh period). Moreover, the PWM waveform may be a non-linear function of the pixel value. In addition, the PWM waveform may be programmed to match the transfer characteristics of the LC material.

Such a single "ON" pulse based technique may afford several advantages in one embodiment of the present invention. For instance, by providing a single "ON" pulse, a display device or display system architecture (e.g., digital pixel architectures for a digital SLM device) may better control the LC material being driven. In contrast, this type of control may be significantly lacking in some situations with approaches that add up multiple non-overlapping pulses to build the PWM waveform. By allowing total programmability of the PWM waveform, in one embodiment, the display device or display system architecture may be relatively better tuned to a particular LC material than a system that simply uses a fixed waveform, as this scheme may allow the duty cycle of the fixed waveform to vary either as a linear or nonlinear function of pixel value with a single "ON" pulse.

Figure 12:
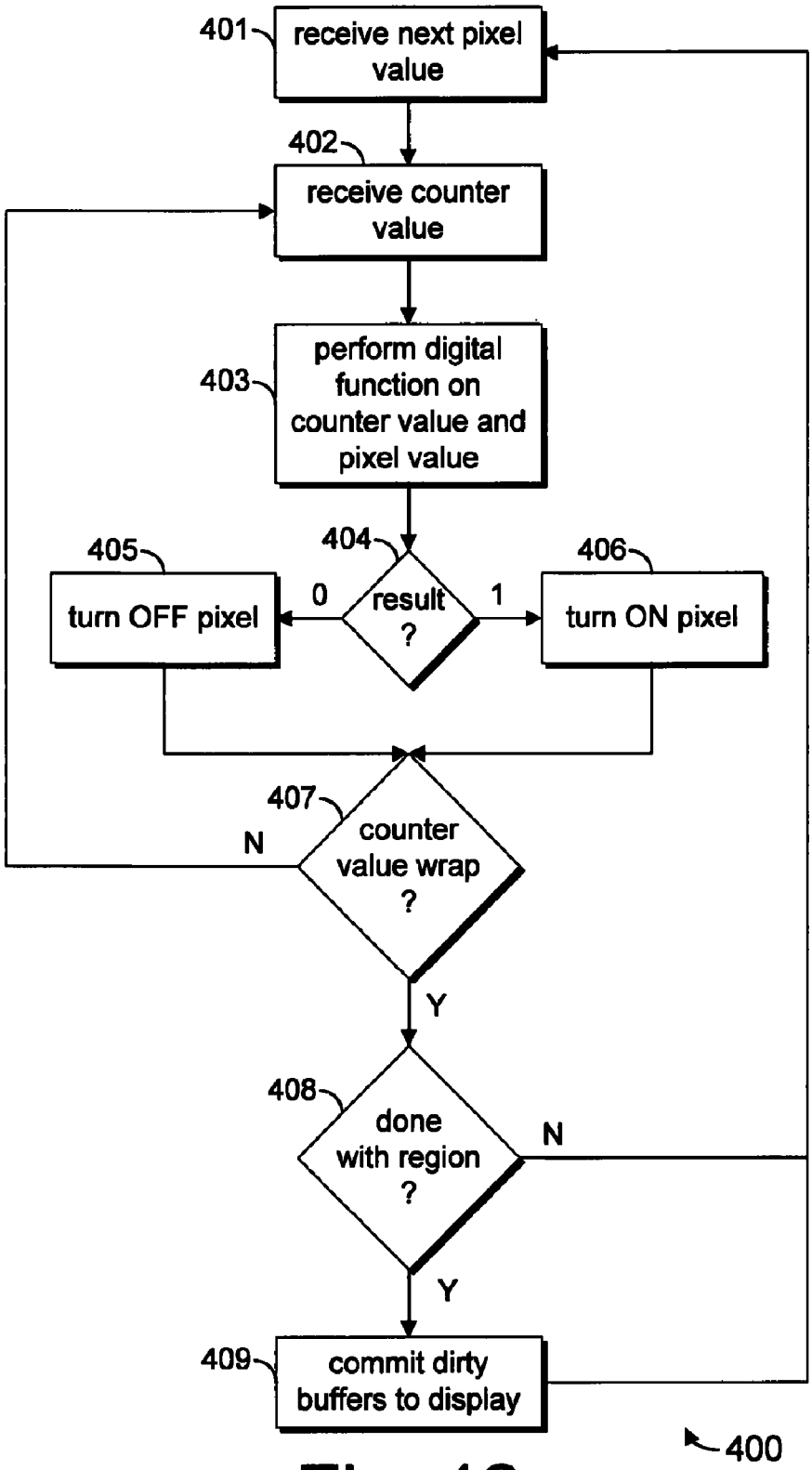
FIG. 12 illustrates one embodiment of a method of operation of the invention.

FIG. 12 illustrates one embodiment of a method 400 of operation of the invention. A pixel value is received (401) from the pixel value source. A counter value is received (402) from the global counter. A digital function is performed (403) on the counter value and the pixel value. As described above, the digital function may be a comparison, or other suitable operation. If (404) the digital operation gave a first result ("0"), the pixel is turned off (405). Otherwise, if the digital operation gave a second result ("1"), the pixel is turned on (406). The reader will appreciate that the digital operation need not be a binary operation.

The reader will further appreciate that, in many embodiments, it will be desirable to maintain some degree of synchronization between the counter update events, the pixel value events, and the display commit events. In one typical embodiment, the pixel values may arrive asynchronously with regard to the counter increment events, but the pixel commit events may be synchronized with the counter events such that the commit only happens when the counter has reached the end of a counter cycle, such as when it wraps (407) back around to an initial value such as zero. This synchronization will help avoid presentation of false pixel values to the display, or, in other words, latching incompletely-ramped values to the output.

At the appropriate synchronization time, if (408) the region update has not been completed, operation continues by receiving a next pixel value (401). Otherwise, the new pixel values are committed (409) to the display. Then, operation can continue with updating of a next region or frame. The reader will appreciate that this is but one example of a method of operation of a double-buffering system according to this invention, and that various modifications can readily be made to this example method within the scope of the invention.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A spatial light modulator comprising:

a multi-pixel display array formed on a first die; and a multi-pixel memory array formed on a second die separate from the first die, the multi-pixel memory array having pixel storage cells, and wherein the multi-pixel memory array is physically decoupled from the multi-pixel display array and the multi-pixel display array does not include a storage device to store pixel values.

2. The spatial light modulator of claim 1, wherein all of the pixels of the memory array are disposed outside the display array.

3. The spatial light modulator of claim 1, further comprising:

at least one local pulse width modulation drive circuit coupled to at least one of the pixel storage cells; and a global counter coupled to the local pulse width modulation drive circuit to provide a global count value thereto.

4. The spatial light modulator of claim 3, wherein:

the display pixels of the multi-pixel display array comprise first display pixels of a first color, and second display pixels of a second color; and the global counter includes a first global counter coupled to the local pulse width modulation drive circuits of the first display pixels and a second global counter coupled to the local pulse width modulation drive circuits of the second display pixels.

5. The spatial light modulator of claim 4, wherein the display pixels of the multi-pixel display array further comprise third pixels of a third color.

6. The spatial light modulator of claim 5, wherein the global counter further includes a third global counter coupled to the local pulse width modulation drive circuits of the third display pixels.

7. The spatial light modulator of claim 3, wherein the multi-pixel display array includes display pixels of at least two different colors; and the global counter is to count up to two respective different values and is switcheably coupled to the respective different color display pixels to provide global counter values to their local pulse width modulation drive circuits in a time-slice manner.

8. The spatial light modulator of claim 7, wherein the multi-pixel display array includes display pixels of three different colors.

9. The spatial light modulator of claim 1, wherein the spatial light modulator comprises a liquid crystal on silicon display.

10. The spatial light modulator of claim 1, wherein each of the pixel storage cells is associated with one pixel of the multi-pixel display array.

11. The spatial light modulator of claim 1, wherein the multi-pixel display array is formed using a first semiconductor technology and the multi-pixel memory array is formed using a second semiconductor technology.

12. A spatial light modulator comprising:

control logic;

a pixel memory array coupled to the control logic and formed on a first die; and a pixel display array coupled to the control logic and the pixel memory array, and formed on a second die, wherein the first and second die are physically decoupled and substantially non-overlapping, the pixel display array comprising a plurality of pixel display cells, each having disposed within its area an associated pulse width modulation driver circuit, and the pixel memory array comprising a redundancy mechanism and more memory cells than the pixel display array has pixel display cells.

13. The spatial light modulator of claim 12, wherein:

the control logic comprises a counter to provide a count value;

the pulse width modulation driver circuit comprises a comparator coupled to compare the count value to a pixel value stored in an associated pixel array cell of the pixel memory array.

14. The spatial light modulator of claim 12, wherein the spatial light modulator comprises a liquid crystal on silicon display.

15. The spatial light modulator of claim 12, wherein each of a plurality of pixel memory cells is associated with one pixel display cell of the pixel display array.

16. A method comprising:

performing a digital function on a pixel data value and a present counter value to generate one of a first result or a second result, wherein a pixel memory array of a first die stores the pixel data value and the pixel memory array is physically decoupled from a pixel display array of a second die;

activating or deactivating a pixel cell of the pixel display array based on the digital function; and logically replacing a pixel memory cell with a redundant memory cell if the pixel memory cell is detected to not be operating correctly.

17. The method of claim 16, further comprising incrementing the present counter value from 0 to N−1, wherein N is a number of bits of color depth represented in the pixel data value, and then wrapping back to 0.

18. The method of claim 16, wherein the digital function comprises using the present counter value to index into a lookup table.

* * * * *